United States Patent [19]

Yamada et al.

[11] 4,073,651

[45] Feb. 14, 1978

[54] IMAGE-FORMING LAYER CONTAINING SILVER HALIDE EMULSION AND MAGENTA COUPLER

[75] Inventors: Shoji Yamada; Akira Tanaka; Shoichi Horii; Kiyoshi Yamashita, all of Nagaokakyo, Japan

[73] Assignee: Mitsubishi Paper Mills, Ltd., Tokyo, Japan

[21] Appl. No.: 679,083

[22] Filed: Apr. 21, 1976

[30] Foreign Application Priority Data

Apr. 28, 1975 Japan ..... 50-51907

[51] Int. Cl.[2] ..... G03C 1/40

[52] U.S. Cl. ..... 96/100 R; 96/56.5

[58] Field of Search ..... 96/100, 56.5

[56] References Cited

U.S. PATENT DOCUMENTS

| | | | |
|---|---|---|---|
| 3,891,445 | 6/1975 | Arai et al. | 96/100 |
| 3,935,016 | 1/1976 | Nishimura et al. | 96/100 |
| 3,973,979 | 8/1976 | Meier et al. | 96/100 |

*Primary Examiner*—J. Travis Brown

*Attorney, Agent, or Firm*—Cushman, Darby & Cushman

[57] ABSTRACT

An image-forming layer containing silver halide emulsion and a magenta coupler represented by the general formula:

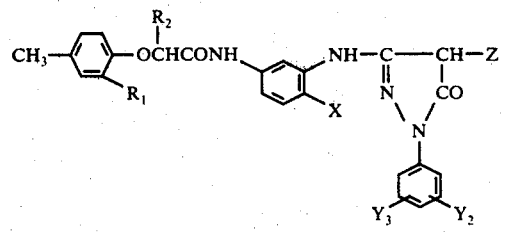

wherein $R_1$ represents an alkyl group having 10 to 18 carbon atoms, $R_2$ represents hydrogen atom or an alkyl group having 1 to 4 carbon atoms, X represents a halogen atom, an alkyl group having 1 to 4 carbon atoms, or an alkoxy group having 1 to 4 carbon atoms, $Y_1$ represents an alkyl group having 1 to 4 carbon atoms, an alkoxy group having 1 to 4 carbon atoms, or a halogen atom, $Y_2$ and $Y_3$, which may be the same or different, represent hydrogen atoms or have the meaning assigned to $Y_1$, and Z represents hydrogen atom or the atom or group which splits off by coupling.

10 Claims, No Drawings

IMAGE-FORMING LAYER CONTAINING SILVER HALIDE EMULSION AND MAGENTA COUPLER

BACKGROUND OF THE INVENTION

This invention relates to photography and particularly to a novel magenta coupler and their use in color photography.

It is well known that in color development the exposed silver halide in a silver halide emulsion layer oxidizes the primary aromatic amino developing agents, and the resulting oxidized products react with couplers to form dyes, thus resulting in formation of color images.

The role played by a coupler in color photography based on chromogenic development is very important and the stability of the color image, which is an important factor in color photography, depends largely on the couplers. For this reason, couplers and the dyes formed therefrom must generally meet a number of requirements.

Magenta couplers are required to satisfy particularly the following conditions:

(1) The coupler must be easily soluble in high-boiling solvents such as dibutyl phthalate and tricresyl phosphate and dispersible in the silver halide emulsion by use of a small amount of the solvent.

(2) The coupler remaining in the photographic material after the developing treatment must not turn yellow by the action of light, moisture, or heat, leaving stains on the photographic material.

(3) The coupler must have a high chromogenic efficiency, forming a magenta dye of high color density.

(4) The magenta dye formed from the coupler on chromogenic development must have such spectral absorption characteristics that the secondary absorption in blue ray region is low and the flank to the longer wavelengths in the absorption curve is steep.

(5) The magenta dye formed must be stable to light, moisture, and heat, permitting long storage without significant discoloration or fading.

Most of the conventionally known magneta couplers of the protected type are pyrazolone derivatives which are classified broadly into four groups of 1-aryl-3-alkyl-5-pyrazolones, 1-aryl-3-acylamino-5-pyrazolones, 1-aryl-3-ureido-5-pyrazolones, and 1-aryl-3-anilino-5-pyrazolones. Of these, 1-aryl-3-anilino-5-pyrazolones yield magenta dyes most excellent in spectral absorption characteristics which are the most important factor in color reproduction. As compared with the magenta dyes formed from other groups of pyrazolone derivatives, that obtained from 1-aryl-3-anilino-5-pyrazolones show the principal wavelength absorption maximum at somewhat shorter wavelength; smaller secondary absorption; and particularly smaller unnecessary absorption in the red ray region of longer wavelengths. Most of the dyes of this type, however, tend to fade when exposed to moisture and heat. Such defects have been improved in the 1-aryl-3-anilino-5-pyrazolone couplers having an alkoxy or halogen substituent at ortho-position with respect to the anilino group, which have been proposed by British Patent No. 956,261. The coupler of this type has advantages in that the magenta dye formed has a good fastness and a high color density owing to a high chromogenic efficiency of the coupler. Among such couplers, those represented by the following general formula have been used as the protected-type couplers.

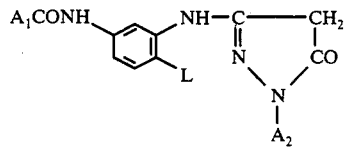

wherein L represents a halogen atom, an alkoxy group, or an alkyl group, $A_1CO$ represents an acyl group, and $A_2$ represents an aryl group.

In order to make a coupler usable as the protected-type coupler which is dissolved in a high-boiling solvent and dispersed in the silver halide emulsion, it is necessary to introduce into the coupler an oil-soluble and non-diffusing group having 8 or more carbon atoms. As the non-diffusing and oil-soluble group, certain substituted phenoxyalkyl groups have been proposed by U.S. Pat. Nos. 2,423,730, 2,474,293, and 2,908,573. It has been known that alkylphenoxyalkyl groups such as, for example, α-(2,4-di-tert-pentylphenoxy)-propyl group and α-(3-pentadecylphenoxy)-propyl group are useful for magenta couplers of the pyrazolone type. However, as described hereinafter the 1-aryl-3-anilino-5-pyrazolone derivatives obtained by introducing these non-diffusing oil-soluble groups into the pyrazolones of the above formula have high melting points and low solubilities or, even if melting points are low, tend to crystallize in the emulsion layer. For these reasons, such derivatives of the 1-aryl-3-anilino-5-pyrazolones are not suitable for practical use as the protected-type coupler.

SUMMARY OF THE INVENTION

An object of this invention is to provide a magenta coupler free from the above-said defects of the conventional 1-aryl-3-anilino-5-pyrazolone couplers.

The present inventors have now found that the 1-aryl-3-anilino-5-pyrazolones represented by the following general formula are excellent magenta couplers capable of meeting all the requirements for the protected-type magenta coupler.

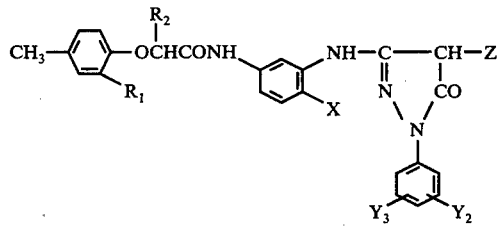

wherein $R_1$ represents an alkyl group having 10 to 18 carbon atoms, $R_2$ represents hydrogen atom or an alkyl group having 1 to 4 carbon atoms, X represents a halogen atom, an alkyl group having 1 to 4 carbon atoms (such as for example, methyl or ethyl group), or an alkoxy group having 1 to 4 carbon atoms (such as, for example, methoxy or ethoxy group), $Y_1$ represents an alkyl group having 1 to 4 carbon atoms (such as, for example, methyl, ethyl, or butyl group), an alkoxy group having 1 to 4 carbon atoms (such as, for example, methoxy or ethoxy group), or a halogen atom, $Y_2$ and $Y_3$, which may be either the same or different, represent hydrogen atoms or have the meaning assigned to $Y_1$, and Z represents hydrogen atom or the atom or group which splits off by coupling.

The compounds represented by said general formula in which X is chlorine have a great effect in prevention of fading of color caused by moisture and heat and furthermore the compounds represented by said general formula wherein $Y_1$, $Y_2$ and $Y_3$ are chlorine are excellent in spectral absorption characteristic.

DESCRIPTION OF THE PREFERRED EMBODIMENTS

Typical examples of the magenta couplers according to this invention are given below, but the invention is not limited thereto.

(1)

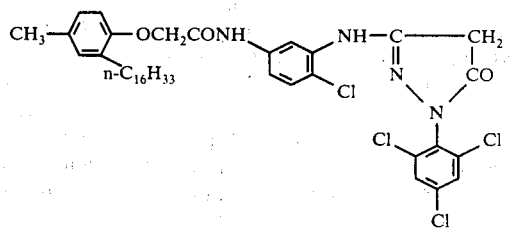

(2)

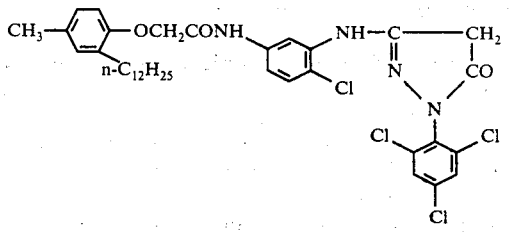

(3)

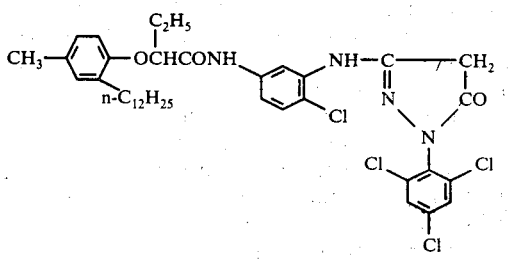

(4)

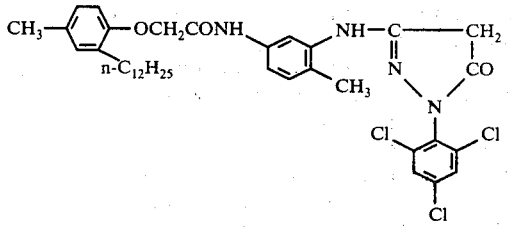

(5)

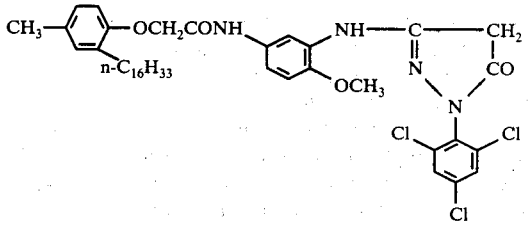

(6)

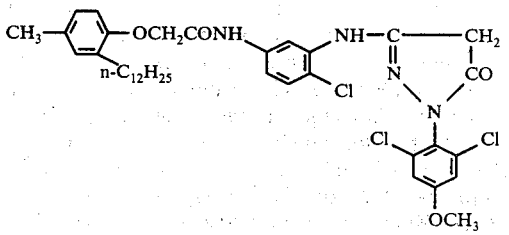

-continued (7)

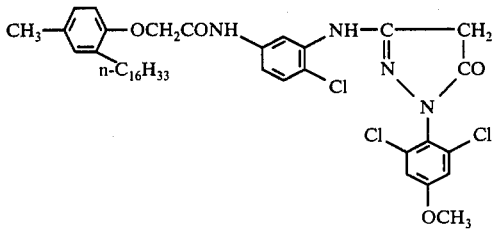

(8)

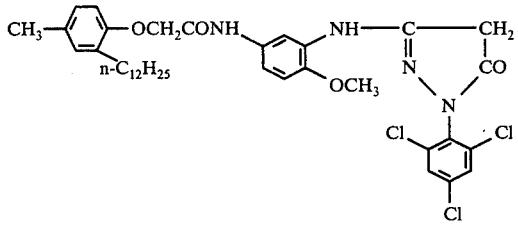

(9)

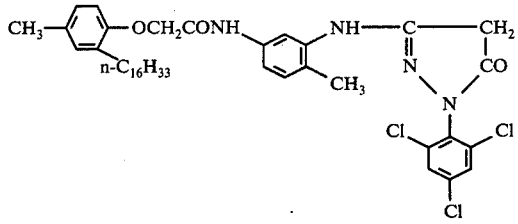

(10)

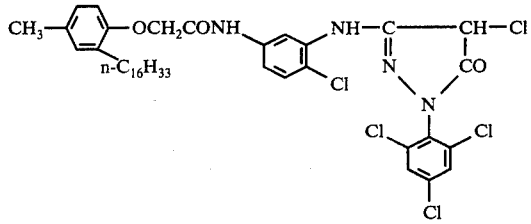

(11)

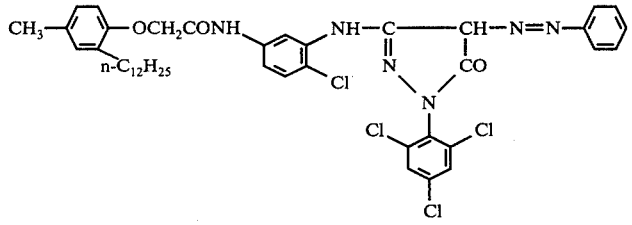

Suitable amount of the magenta coupler of the present invention in the image forming emulsion layer is 20 to 600 g per 1 mol of the silver halide.

The 3-anilino-5-pyrazolone magenta couplers of the present invention can be synthesized in various ways. For instance, it is produced by reacting an alkyl $\beta,\beta$-dialkoxyacrylate with an arylamine and then condensing the resulting intermediate compound with an arylhydrazine, as described in French Patent No. 1,449,259; by reacting an alkyl $\beta,\beta$, $\beta$-trialkoxypropionate with an arylamine and then condensing the resulting intermediate compound with an arylhydrazine, as described in Belgian Patent No. 770,972; by reacting an alkyl $\beta$-phenoxy-$\beta$-iminopropionate with an arylamine and then condensing the resulting intermediate compound with an alkylhydrazine, as described in German Patent Laid-open ("Offenlegungsschrift") 2,300,221; or by reacting a 3-alkoxy-5-pyrazolone with an arylamine, as described in U.S. Pat. No. 3,615,506.

Detailed examples of procedures for synthesizing typical couplers of the present invention are given below. Other couplers may be synthesized in similar manners.

PREPARATION EXAMPLE 1

Synthesis of 1-(2,4,6-trichlorophenyl)-3-{2-chloro-5-(2-n-hexadecyl-4-methylphenoxy)-acetamidoanilino}-5-pyrazolone {Coupler (1)}.

(1) Synthesis of 1-(2,4,6-trichlorophenyl)-3-(2-chloro-5-nitroanilino)-5-pyrazolone.

To a mixture comprising 30.8 g of 1-(2,4,6-trichlorophenyl)-3-ethoxy-5-pyrazolone and 19 g of 2-chloro-5-nitroaniline, were added 30 ml of xylene and 10.6 g of methanesulfonic acid. The resulting mixture was heated with stirring at an external temperature of 150° to 160° C. for 4 hours. After removing xylene by distillation, the reaction mixture was admixed with 100 ml of methanol. The yellow crystals deposited were collected by filtration and washed with methanol to obtain 22.9 g of the intended compound having a melting point of 284° C.

(2) Synthesis of 1-(2,4,6-trichlorophenyl)-3-(5-amino-2-chloroanilino)-5-pyrazolone.

To 80-% aqueous acetic acid containing 10.2 g of iron powder, while being stirred and heated, was added 13.3 g of 1-(2,4,6-trichlorophenyl)-3-(2-chloro-5-nitroanilino)-5-pyrazolone obtained in (1). The mixture was further refluxed for 1 hour. The reaction mixture was filtered to remove the iron powder. After evaporation of acetic acid and water the residue was admixed with acetone to precipitate white crystals. The crystals were collected by filtration and washed with ethanol to obtain 11.5 g of the intended compound having a melting point of 236° C.

(3) Synthesis of 2-hexadecyl-4-methylphenol.

A mixture comprising 32.4 g of p-cresol, 36.4 g of 1-hexadecanol, and 40.9 g of zinc chloride was heated at 180° to 190° C. for 10 hours. After the addition of 20.3 g of zinc chloride, the mixture was heated for another 10 hours. The reaction mixture was cooled to room temperature, admixed with 200 ml of water, and the oily matter was extracted with 200 ml of ethyl acetate. After evaporation of the ethyl acetate, the residue was distilled under reduced pressure to obtain 38.2 g of the intended compound boiling at 214°–220° C. at 4 mmHg.

(4) Synthesis of ethyl 2-hexadecyl-4-methylphenoxyacetate.

Into 250 ml of acetone, were added 29.8 g of 2-hexadecyl-4-methylphenol obtained in (3), 13.1 g of ethyl chloroacetate, and 17.1 g of potassium carbonate. The mixture was refluxed for 15 hours and the insoluble matter was removed by filtration. After evaporation of the acetone from the filtrate, the residue was distilled under reduced pressure to obtain 27.3 g of the intended compound boiling at 230° to 240° C. at 4 mmHg.

(5) Synthesis of 2-hexadecyl-4-methylphenoxyacetic acid.

To a mixture comprising 50 ml of methanol, 5 ml of water, and 3.78 g of potassium hydroxide, was added 23.5 g of ethyl 2-hexadecyl-4-methylphenoxyacetate. The mixture was refluxed for 2 hours. After evaporation of the methanol from the reaction mixture, the residue was admixed with 50 ml of 3 N hydrochloric acid and the oily matter was extracted with 200 ml of benzene. The benzene was evaporated from the extract, leaving behind 20.1 g of the intended compound in the form of crystal.

(6) Synthesis of 2-hexadecyl-4-methylphenoxyacetyl chloride.

To 20.1 g of 2-hexadecyl-4-methylphenoxyacetic acid, was added 20 ml of thionyl chloride. The mixture was refluxed for 2 hours and thereafter the excess thionyl chloride was evaporated from the reaction mixture, leaving behind 21.7 g of the intended compound as the residue. This product was used in the succeeding reaction step.

(7) Synthesis of 1-(2,4,6-trichlorophenyl)-3-{2-chloro-5-(2-hexadecyl-4-methylphenoxy)acetamidoanilino}-5-pyrazolone.

To a mixture comprising 50 ml of acetonitrile and 50 ml of glacial acetic acid, were added 1.8 g of sodium acetate and 8.1 g of 1-(2,4,6-trichlorophenyl)-3-(5-amino-2-chloroanilino)-5-pyrazolone obtained in (2). After addition, with stirring, of 9.0 g of 2-hexadecyl-4-methylphenoxyacetyl chloride obtained in (6), the reactant mixture was further stirred at room temperature for 2 hours. The insoluble matter was removed from the reaction mixture by filtration and the filtrate was evaporated to remove the solvent. The residue was crystallized from acetonitrile to obtain 10.1 g of the intended compound melting at 122° to 123.5° C.

Elementary analysis (%): Found: C, 61.93; H, 6.46; N, 7.19 Calculated: C, 61.85; H, 6.48; N, 7.21.

PREPARATION EXAMPLE 2

Synthesis of 1-(2,4,6-trichlorophenyl)-3-{2-chloro-(2-n-dodecyl-4-methylphenoxy)acetamido}-5-pyrazolone {Coupler (2)}.

(1) Synthesis of 2-dodecyl-4-methylphenoxyacetyl chloride.

The intended compound was obtained from 1-dodecanol in place of 1-hexadecanol used in (3) of Preparation Example 1 by following the procedures similar to those described in (4), (5), and (6) in Preparation Example 1.

(2) Synthesis of 1-(2,4,6-trichlorophenyl)-3-{2-chloro-5-(2-n-dodecyl-4-methylphenoxy)acetamidoanilino}-5-pyrazolone.

The intended compound having a melting point of 115.5°–116° C. was obtained in the same manner as in (7) of Preparation Example 1, except that 2-dodecyl-4-methylphenoxyacetyl chloride obtained in (1) was used in place of the 2-hexadecyl-4-methylphenoxyacetyl chloride.

PREPARATION EXAMPLE 3

Synthesis of 1-(2,4,6-trichlorophenyl)-3-{2-chloro-5-α-(2-dodecyl-4-methylphenoxy)butyramidoanilino}-5-pyrazolone {coupler (3)}.

(1) Synthesis of α-(2-dodecyl-4-methylphenoxy) butyric acid.

To a solution of 5.1 g of metallic sodium in 150 ml of isopropyl alcohol, were added 16.7 g of α-bromo-n-butyric acid and 27.6 g of 2-dodecyl-4-methylphenol obtained by using 1-dodecanol in place of the 1-hexadecanol in (3) of Preparation Example 1. The resulting mixture was heated under reflux for 50 hours. After evaporating the solvent, the reaction mixture was mixed with 150 ml of water, adjusted to pH 2 or less with concentrated hydrochloric acid, and the oily matter was extracted with 150 ml of benzene. After evaporation of the benzene from the benzene extract, the residue was distilled under reduced pressure to yield 20.0 g of the intended compound boiling at 200°–212° C. at 0.25 mmHg.

(2) Synthesis of α-(2-dodecyl-4-methylphenoxy)-butyryl chloride.

The intended product was obtained from α-(2-dodecyl-4-methylphenoxy)butyric acid obtained in (1) by following the procedure described in (6) of Preparation Example 1.

(3) Synthesis of 1-(2,4,6-trichlorophenyl)-3-{2-chloro-5-α-(2-dodecyl-4-methylphenoxy)-butyramidoanilino}-5-pyrazolone.

Following the procedure described in (7) of Preparation Example 1, the intended compound melting at 94.0°–95.0° C. was obtained from α-(2-dodecyl-4-methylphenoxy)butyryl chloride prepared in (2) in place of the 2-hexadecyl-4-methylphenoxyacetyl chloride.

Elementary analysis: Found (%): C, 61.18; H, 6.21; N, 7.55; Calculated (%): C, 60.96; H, 6.19; N, 7.48.

The magenta coupler of this invention may be easily prepared, as described above in Preparation Examples 1, 2, and 3, from p-cresol as main starting material, which is produced on a large scale and readily available. It has sufficient solubilities in high-boiling solvents, such as dibutyl phthalate and tricresyl phosphate, and is an efficient color former. Moreover, the magenta dye produced from the present coupler on color development has spectral absorption characteristics favorable to color reproduction and, in addition, sufficient fastness to light, moisture, and heat, permitting a long storage.

The invention is further illustrated below in detail with reference to Examples. In Examples, the following magenta couplers bearing structural resemblance to the present couplers were used for comparison.

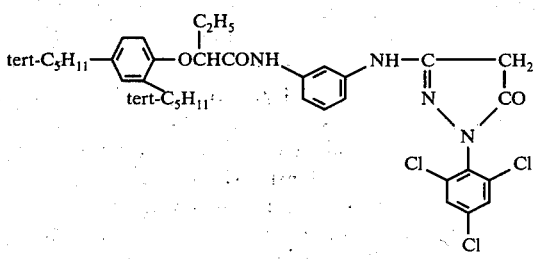
(I)

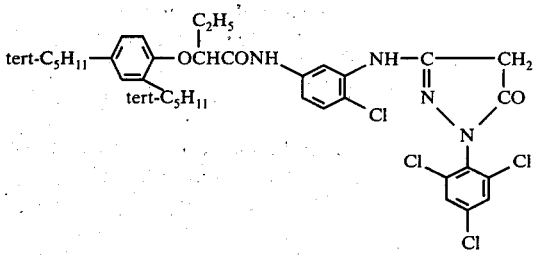
(II)

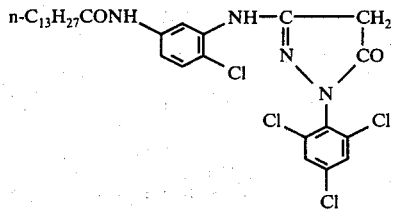
(III)

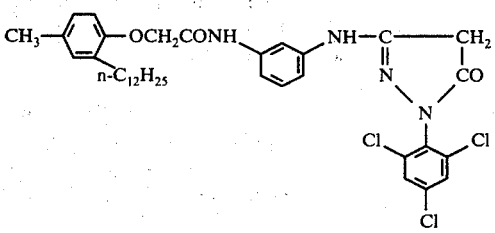
(IV)

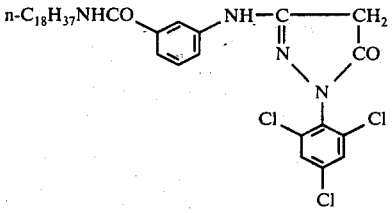
(V)

-continued

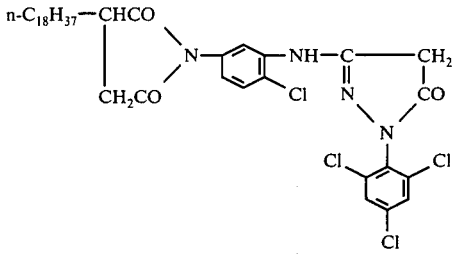
(VI)

EXAMPLE 1

Solubilities in high-boiling solvent of the present couplers (1), (2), and (3) and comparative couplers (I), (II), and (VI) were tested. The quantity in ml of dibutyl phthalate, used as high-boiling solvent, required for dissolving each coupler at 75° C. was measured and the time required before crystals appeared in a drop of said dibutyl phthalate solution placed on a sheet of glass and left standing at 25° C. was also measured. The results obtained were as shown in Table 1.

Table 1

| Coupler | Quantity of dibutyl phthalate, ml | Time elapsed before appearance of crystal |
|---|---|---|
| The present coupler (1) | 1.0 | 24 hours |
| (2) | 1.0 | 24 hours |
| (3) | 1.0 | >24 hours |
| Comparative coupler (I) | 9.0 | 10 min. |
| (II) | 11.0 | 10 min. |
| (VI) | 1.0 | 30 min. |

As is apparent from Table 1, the present couplers are superior in the solubility in dibutyl phthalate to the comparative couplers.

EXAMPLE 2

By using the present couplers (1) and (3) and the comparative couplers (II), (III), and (IV), emulsions containing the coupler and silver halide in a molar ratio of 2 to 1 were prepared. Each emulsion was coated on a sheet of undercoated polyester film and dried to prepare five sensitive materials having stable coatings. The application rate of each emulsion corresponded to 3.3 $\times 10^{-3}$ mole of the coupler per square meter. Dibutyl phthalate was used as solvent for the coupler and ethyl acetate or a mixture of ethyl acetate and dimethylformamide was used as auxiliary solvent. The five photosensitive materials thus obtained were exposed in a customary way and developed for 6 minutes in a color developing solution of the following composition:

| | |
|---|---|
| Sodium hydroxide | 1.65 g |
| Sodium metaborate | 50 g |
| Anhydrous sodium sulfite | 1.8 g |
| Potassium bromide | 0.5 g |
| 4-Amino-N-ethyl-N-(β-methanesulfonamidoethyl)-m-toluidine sesquisulfate monohydrate | 4.4 g |
| Sodium hexametaphosphate | 0.5 g |
| Hydroxylamine hydrochloride | 1.0 g |
| Benzyl alcohol | 24 ml |
| Diethylene glycol | 10 ml |
| Make up with water to | 1 liter |

The developed material was then bleached and fixed in an iron ethylenediaminetetraacetate bleaching and fixing solution of the following composition:

| | |
|---|---|
| Iron ethylenediaminetetraacetate | 56 g |
| Disodium ethylenediaminetetraacetate | 2 g |
| Ammonium thiosulfate | 60 g |
| Anhydrous sodium sulfite | 20 g |
| Disodium phosphate | 12 g |
| Sodium hydrogensulfite | 5 g |
| Make up with water to | 1 liter |

Thereafter the material was washed with water for 8 minutes, immersed in a fixing bath for 3 minutes, and dried to obtain a test specimen.

The spectral absorption in visible range of each test specimen was measured by means of a spectrophotometer (UV-200 type of Shimazu Seisakusho Ltd.). In Table 2 are shown the wavelength of absorption maximum and steepness (in terms of ΔA and ΔB) of the flank to the longer wavelengths of each specimen. ΔA and ΔB were obtained by normalizing the absorption curve to a maximum density of 1.0, ΔA being the wavelength range between the wavelength corresponding to an absorption density of 0.5 in the longer wavelengths region and the wavelength of maximum absorption density; ΔB being the wavelength range between the wavelength corresponding to an absorption density of 0.1 in the longer wavelengths region and the wavelength of maximum absorption density.

Table 2

| Coupler | Wavelength of max. absorption nm | ΔA nm | ΔB nm |
|---|---|---|---|
| The present coupler (1) | 537.1 | 33.5 | 73.0 |
| The present coupler (3) | 538.0 | 34.0 | 76.5 |
| Comparative coupler (II) | 535.9 | 38.1 | 81.0 |
| Comparative coupler (III) | 540.0 | 36.0 | 78.5 |
| Comparative coupler (IV) | 532.0 | 38.0 | 89.0 |

As is apparent from Table 2, it was found that as compared with the magenta dyes from comparative couplers, those obtained from the present couplers have superior spectral absorption characteristics for color reproduction, the absorption maxima being at wavelengths ranging from 535 to 540 nm and the flank to longer wavelengths region being steeper.

EXAMPLE 3

In a manner similar to that in Example 2, five kinds of test specimens were prepared by using the present couplers (1) and (3) and the comparative couplers (I), (IV), and (V). The density of yellow color of the unexposed portion of each specimen was measured by means of a densitometer (Type TD-404 of Macbeth Co.) with a blue filter. The same specimen was left standing for one month in a constant humidity cabinet kept at 50° C. and a relative humidity of 80% and the density of yellow color was again measured in the same manner as before to examine the increase in the density of yellow color of the unexposed portion of the specimen. The density of magenta color on the exposed portion was also measured before and after application of moisture and heat by means of the same densitometer as above but with a green filter to examine the change in developed color brought about by heat and moisture. The results obtained were as shown in Table 3.

In Table 3, $\Delta D_{min.}^{B}$ represents the difference in the density of yellow color of unexposed portion before and after the wet heat treatment and $\Delta D_{1.0}^{G}$ represents the difference in the density of magenta color of exposed portion at the density of 1.0 before and after moisture and heat treatment.

Table 3

| Coupler | $\Delta D^{B}$min. | $\Delta D^{G}$1.0 |
|---|---|---|
| The present coupler (1) | 0.01 | 0.06 |
| The present coupler (3) | 0.02 | 0.10 |
| Comparative coupler (I) | 0.01 | 0.48 |
| Comparative coupler (IV) | 0.01 | 0.52 |
| Comparative coupler (V) | 0.02 | 0.49 |

As is apparent from Table 3, it was found that the test specimens prepared by use of the present couplers are very stable to heat and moisture, the yellowing of the unexposed portion and also the change in developed magenta color being not significant.

EXAMPLE 4

In a manner similar to that in Example 2, five kinds of test specimens were prepared by using the present couplers (1) and (3) and the comparative couplers (III), (IV), and (V). The density of yellow color of the unexposed portion of each specimen and the density of magenta color of the exposed portion of each specimen were measured in the same manner as in Example 3. Thereafter, each specimen was exposed to direct sunlight for 2 weeks. The density of yellow color of the unexposed portion was again measured in the same manner as above to examine the yellow staining due to the sunlight. The density of magenta color of the exposed portion was also measured to examine the change in developed magenta color due to the sunlight. The results obtained were as shown in Table 4.

In Table 4, $\Delta D_{min.}^{B}$ represents the difference in the density of yellow color of unexposed portion before and after exposure to the sunlight and $\Delta D_{1.0}^{G}$ represents the difference in the density of magenta color of exposed portion at the density of 1.0 before and after exposure to the sunlight.

Table 4

| Coupler | $\Delta D^{B}$min. | $\Delta D^{G}$1.0 |
|---|---|---|
| The present coupler (1) | 0.06 | 0.12 |
| The present coupler (3) | 0.06 | 0.13 |
| Comparative coupler (III) | 0.11 | 0.15 |
| Comparative coupler (IV) | 0.12 | 0.20 |
| Comparative coupler (V) | 0.11 | 0.33 |

As is apparent from Table 4, it was found that the test specimens prepared by use of the present couplers afford color images of high fastness to light, the increase in the density of yellow color of the unexposed portion as well as the fading of the developed magenta color being not significant.

What is claimed is:

1. An image-forming layer containing silver halide emulsion and a magenta coupler 1-aryl-3-anilino-5-pyrazolones represented by the general formula:

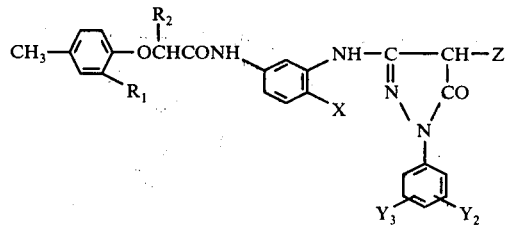

wherein $R_1$ represents an alkyl group having 10 to 18 carbon atoms, $R_2$ represents hydrogen atom or an alkyl group having 1 to 4 carbon atoms, X represents a halogen atom, an alkyl group having 1 to 4 carbon atoms, or an alkoxy group having 1 to 4 carbon atoms, $Y_1$ represents an alkyl group having 1 to 4 carbon atoms, an alkoxy group having 1 to 4 carbon atoms, or a halogen atom, $Y_2$ and $Y_3$, which may be the same or different, represent hydrogen atoms or have the meaning assigned to $Y_1$, and Z represents hydrogen atom or the atom or group which splits off by coupling.

2. An image-forming layer according to claim 1, wherein the amount of the magenta coupler in the layer is 20–600 g per one mol of the silver halide.

3. An image-forming layer according to claim 1, wherein X in the general formula represents chlorine.

4. An image-forming layer according to claim 3, wherein $Y_1$–$Y_3$ in the general formula represent chlorine.

5. An image-forming layer according to claim 1, wherein the magenta coupler is

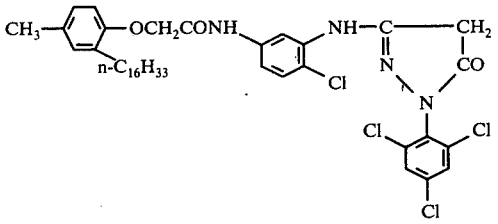

6. An image-forming layer according to claim 1, wherein the magenta coupler is

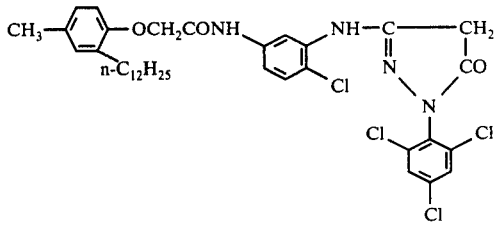

7. An image-forming layer according to claim 1, wherein the magenta coupler is

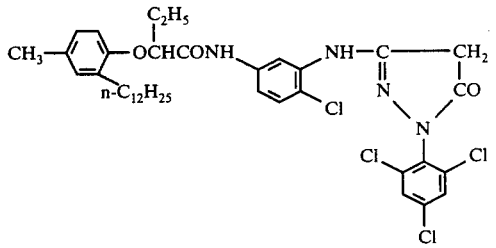

8. A light sensitive material for color photography which contains the image-forming layer defined in claim 1.

9. An image-forming layer according to claim 1 wherein Z is hydrogen, chlorine or phenyl azo.

10. An image-forming layer according to claim 1 wherein Z is hydrogen.

* * * * *